United States Patent [19]

Griffith

[11] Patent Number: 4,945,617

[45] Date of Patent: Aug. 7, 1990

[54] SEAT BELT BUCKLE

[75] Inventor: William O. Griffith, Middletown, Ohio

[73] Assignee: General Motors Corporation, Detroit, Mich.

[21] Appl. No.: 325,800

[22] Filed: Mar. 20, 1989

[51] Int. Cl.[5] ..... A44B 11/25

[52] U.S. Cl. ..... 24/633; 24/637

[58] Field of Search ..... 24/633, 634, 635, 636, 24/637, 647

[56] References Cited

U.S. PATENT DOCUMENTS

| | | | |
|---|---|---|---|
| 3,795,030 | 3/1974 | Yates et al. | 24/637 |
| 4,127,922 | 12/1978 | Mita | 24/637 |
| 4,196,500 | 4/1980 | Happel et al. | 24/230 |
| 4,368,563 | 1/1983 | Lentz | 24/637 |
| 4,457,052 | 7/1984 | Hauber | 24/656 |
| 4,577,378 | 3/1986 | Harenberg | 24/635 |
| 4,617,705 | 10/1986 | Anthony et al. | 24/624 |

FOREIGN PATENT DOCUMENTS

| | | | |
|---|---|---|---|
| 225248 | 6/1987 | European Pat. Off. | 24/633 |
| 1494943 | 9/1967 | France | 24/637 |

*Primary Examiner*—Laurie K. Cranmer

*Attorney, Agent, or Firm*—Charles E. Leahy

[57] ABSTRACT

The housing of a seat belt buckle is comprised of C-shaped one-piece stamping having upper and lower legs which are spaced apart to receive the apertured latch plate therebetween. A detent is formed integral with the lower leg and projects upwardly into the path of entry of the apertured latch plate so that the latch plate interacts with the detent to forcibly cam the lower leg downwardly away from the upper leg as permitted by integral elastic yielding of the lower leg relative to the upper leg. The push button is mounted for movement relative to the upper leg and engages the lower leg so that depressing the push button forces the lower leg downwardly to remove the detent from the engagement with the aperture latch plate. The housing is preferably enclosed in a plastic cover which has an entry port aligning the aperture plate for insertion between the upper and lower legs. The upper leg may have a downturned integral tab extending from the end thereof into closely spaced proximity with the end of the lower leg so that upon a forced removal of the apertured latch plate carries the lower leg is carried into engagement with the downturned integral tab to restrain further yielding of the lower leg by the occupant restraining force.

4 Claims, 1 Drawing Sheet

SEAT BELT BUCKLE

The invention relates to a seat belt buckle for a vehicle and more particularly provides a buckle in which a one-piece stamped housing has an integral detent and spring.

BACKGROUND OF THE INVENTION

It is well known in motor vehicles to fixedly mount one end of the seat belt on one side of the seat and to releasably connect the other end of the seat belt at the other side of the seat by a separable seat belt buckle. Such seat belt buckles typically include a housing having a detent which is movable by a spring into the path of entry of an apertured latch plate attached to the seat belt. When the latch belt is inserted, the latch belt cams the detent out of the path of entry of the latch plate against the bias of the spring and then urges the detent into seat belt locking engagement within the aperture of the latch plate. A push button is depressed to move the detent against the spring bias for disengagement from the apertured latch plate to permit removal of the latch plate from the buckle.

Prior art buckles have achieved the aforedescribed combination through the provision of relatively large number of parts including the housing, the push button, the detent, and one or more springs.

It would be desirable to provide a seat belt buckle of simplified construction and fewer parts.

SUMMARY OF THE INVENTION

According to the present invention, the housing of a seat belt buckle is comprised of a generally C-shaped one-piece stamping having upper and lower legs which are spaced apart to receive the apertured latch plate therebetween. A detent is formed integral with the lower leg and projects upwardly into the path of entry of the apertured latch plate so that the latch plate interacts with the detent to forcibly cam the lower leg downwardly away from the upper leg as permitted by integral elastic yielding of the lower leg relative to the upper leg. The push button is mounted for movement relative to the upper leg and engages the lower leg so that depressing the push button forces the lower leg downwardly to remove the detent from the engagement with the apertured latch plate. The housing is preferably enclosed in a plastic cover which has an entry port aligning the apertured plate for insertion between the upper and lower legs. The upper leg may have a downturned integral tab extending from the end thereof into closely spaced proximity with the end of the lower leg so that upon a forced removal of the apertured latch plate the lower leg is carried into engagement with the downturned integral tab to restrain further yielding of the lower leg by the occupant restraining force.

Accordingly, the object, feature and advantage of the invention resides in the provision of a seat belt buckle in which the complexity and number of parts is dramatically reduced by the provision of a one-pieced stamped housing having spaced apart legs, the lower leg being yieldable relative to the upper leg to provide an integral spring and having an integral detent formed thereon for engagement with an apertured latch plate.

A further feature, object and advantage of the invention resides in the provision of a seat belt buckle having a one-piece stamping with upper and lower legs connected by an integral web and having distal ends spaced apart to receive the apertured latch plate, with a downturned integral tab extending from the distal end of the upper leg into close spaced proximity with the distal end of the lower leg so that forced extraction of the apertured latch plate from the housing carries the lower leg into engagement with the downturned integral tab to restrain movement of the lower leg.

DESCRIPTION OF THE PREFERRED EMBODIMENT

Figure 1:
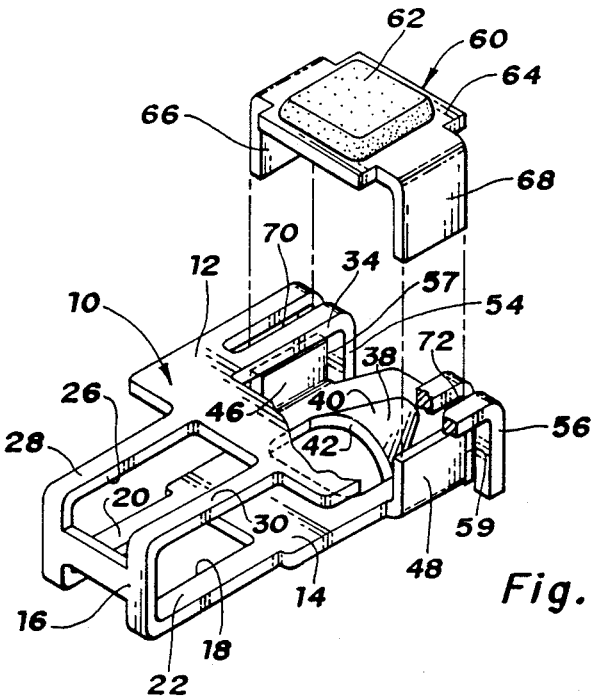
FIG. 1 is a perspective view of the buckle housing and release of the invention.

Referring to FIG. 1, it is seen that a seat belt buckle housing 10 is comprised of a generally C-shaped one piece stamping having an upper leg 12 and a lower leg 14 connected together by an integral web 16. The lower leg 14 has a cutout 18 which defines left and right integral flexure arms or springs 20 and 22. These flexure springs 20 and 22 permit the lower leg 14 to move downwardly relative to the upper leg 12 as will be further discussed hereinafter. The return characteristic may be determined by controlling the width of the flexure springs 20 and 22 as well as the thickness and spring characteristic of the sheet metal.

The upper leg 12 has a cutout 26 which removes material to lighten the buckle housing 10 and defines support portions 28 and 30. The distal end of the upper leg 12 has a rectangular cutout 34 which also lightens the housing 10.

Figure 2:
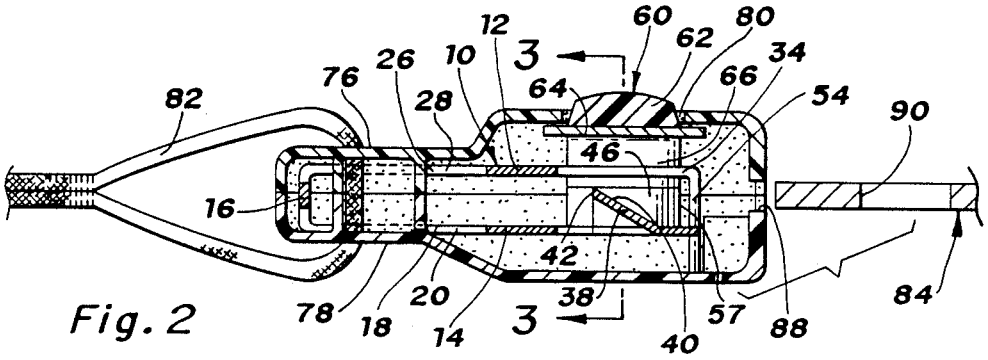
FIG. 2 is a sectional view taken through the seat belt buckle invention.

Referring to FIGS. 1 and 2, it is seen that the lower leg 14 has a detent finger 38 which is struck upwardly from the lower leg 14 adjacent the distal end thereof. The detent finger has a top surface which defines a cam face 40 and also has at the end thereof a locking face 42 which extends perpendicular to the lower leg 14. The lower leg 14 also has flanges 46 and 48 bent upwardly from the edges thereof to extend toward the upper leg 12.

As best seen in FIGS. 1 and 2, the distal ends of the upper leg 12, at each side of the cutout 34, are bent downwardly to form left and righthand downturned integral tabs 54 and 56 which extend downwardly from the upper leg 12 toward the lower leg 14 and straddle the lower leg 14. As seen by reference to FIG. 2, the lefthand downturned tab 54 extends downwardly closely adjacent the forwardmost face 57 of the lefthand flange 46, for reasons which will be discussed further hereinafter. Likewise, the righthand downturned tab 54 extends downward closely adjacent the forwardmost face 59 of the righthand flange 48.

Referring again to FIG. 1, it is seen that a release button assembly 60 includes a plastic push button 62 mounted on a base 64 having downturned operating legs 66 and 68. The upper leg 12 of the housing 10 has a lefthand mounting slot 70 which receives the lefthand operating leg 66 and also a righthand mounting slot 72 which receives the operating leg 68 of the release button. The operating leg 66 and 68 respectively extend into contact with the flanges 46 and 48 of buckle housing lower leg 14 as best seen in FIGS. 2 and 3.

Figure 3:
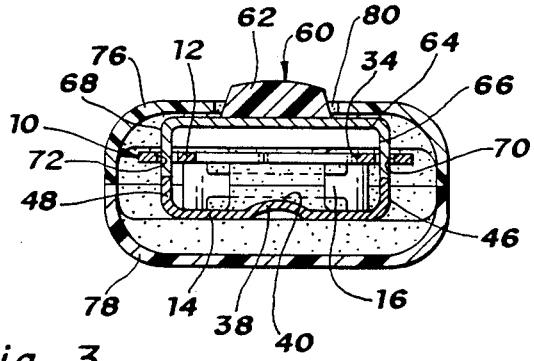
FIG. 3 is a sectional view taken in the direction of arrows 3—3 of FIG. 2.

Referring to FIGS. 2 and 3, it is seen that the buckle housing 10 is enclosed within a cover assembly which includes an upper cover 76 and a lower cover 78 which encircle the housing 10 and are attached together by a rivet, integral plastic snap tabs, or some other known prior art connecting device. The lower cover 78 is spaced somewhat from the lower leg 14 of the housing 12 in order to permit downward movement of the lower leg 14 as will be discussed hereinafter. The upper cover 76 has an opening 80 which registers with the plastic push button 62. A seat belt 82 passes through apertures in the upper and lower cover, and through the cutouts 26 and 18 of the housing 10 to attach the buckle to the vehicle body.

An apertured latch plate generally indicated at 84 is attached to another length of seat belt and is adapted for insertion through an entry port 88 defined by the cover assembly. The entry port 88 aligns the latch plate 84 for insertion between the upper leg 12 and between the flanges 46 and 48 of the lower leg 14. As the latch plate 84 progressively enters the entry port 88 of the buckle cover assembly, the end of the latch plate 84 engages the cam face 40 of the detent finger 38 and forcibly cams the lower leg 14 progressively downwardly. Upon full insertion of the latch plate 84, the aperture 90 of the latch plate 84 aligns with the detent finger 38 permitting the integral flexure springs 20 and 22 of the lower arm 14 to return the lower leg 14 upwardly to the position of FIG. 2 in which the locking face 42 of detent 38 engages with the wall of aperture 90, thereby latching the latch plate 84 into the buckle.

When it is desired to release the latch plate 84 from the buckle, the occupant manually depresses the release button 60 downwardly so that the operating leg 66 and 68 thereof acting on the flanges 46 and 48 move the lower leg 14 downwardly as permitted by flexure of the integral flexure springs 20 and 22. When the detent finger 38 disengages from the aperture 90, the latch plate 84 may be removed from the buckle. Upon release of the release button 60, the integral flexure springs 20 and 22 reposition the lower leg 14 at its normal free state position of FIGS. 2 and 3 in readiness for a subsequent re-insertion of the latch plate.

If an occupant restraint load is imposed upon the seat belt system, the latch plate 84 is forcibly moved in the rightward direction as viewed in FIG. 2 but the removal of the latch plate is prevented by the engagement of detent 38 in the aperture 90. Upon a predetermined load upon the latch plate, the lower leg 14 will yield somewhat in the rightward direction as permitted by flexure of the housing 10 until the forwardmost face 57 and 59 of the flanges 46 and 48 comes into engagement with the downturned tabs 54 and 56 of the upper leg 12 so that the upper leg reinforces the lower leg against further movement upon attempted extraction of the latch plate from the buckle.

It will be appreciated that the latched and unlatched positions of the buckle are characterized by the buckle components being in a load free and relaxed state which prevents deformation of the components over the lifetime of the buckle. Further more the buckle is friction free in operation.

The upper and lower plastic cover 76 and 78 preferably have integral flanges, not shown, which interact with the housing 10 as appropriate to consistently and reliably locate the housing within the cover and also assure that the entry port 88 aligns the latch plate 84 with the intended path of entry between the upper leg 12 and lower leg 14.

Thus it is seen that the invention provides a new and improved seat belt buckle in which a C-shaped one-piece stamping has upper and lower legs and provides an integral detent spring biased by integral flexure springs to engage with an apertured latch plate.

The embodiments of the invention in which an exclusive property or privilege is claimed are defined as follows:

1. In a seat belt buckle of the type having a detent movably mounted in a housing for spring biased movement into engagement with an apertured latch plate insertable into the buckle, and a release button adapted for manual movement to urge the detent against the spring bias thereof to release the apertured latch plate, the improvement comprising:

the housing being a generally C-shaped one-piece stamping having upper and lower legs spaced apart to receive the apertured latch plate therebetween, a detent derived from and part of the one-piece stamping with the lower leg and projecting upward into the path of entry of the apertured latch plate so that the latch plate interacts with the detent to forcibly cam the lower leg downwardly away from the upper leg as permitted by inherent elastic yielding of the lower leg relative to the upper leg.

2. In a seat belt buckle of the type having a detent movably mounted in a housing for spring biased movement into engagement with an apertured latch plate insertable into the buckle, and a release button adapted for manual movement to urge the detent against the spring bias thereof to release the apertured latch plate, the improvement comprising:

the housing being a generally C-shaped one-piece stamping having upper and lower legs spaced apart to receive the aperture latch plate therebetween, a detent derived from and part of the one-piece stamping with the lower leg and projecting upward into the path of entry of the apertured latch plate so that the latch plate interacts with the detent to forcibly cam the lower leg downwardly away from the upper leg as permitted by inherent elastic yielding of the lower leg relative to the upper leg;

and the release button being mounted on the upper leg and being manually movable relative to the upper leg to move the lower leg downwardly and withdraw the detent from the apertured latch plate as permitted by inherent elastic yielding of the lower leg relative to the upper leg.

3. In a seat belt buckle of the type having a detent movably mounted in a housing for spring biased movement into engagement with an apertured latch plate insertable into the buckle, and a release button adapted for manual movement to urge the detent against the spring bias thereof to release the apertured latch plate, the improvement comprising:

the housing being a generally C-shaped one-piece stamping having upper and lower legs connected by an integral web having distal ends spaced apart to receive the apertured latch plate therebetween, a detent derived from and part of the one-piece stamping with the lower leg and projecting upward into the path of entry of the apertured latch plate so that the latch plate interacts with the detent to forcibly cam lower the leg downwardly away from the upper leg and then return the lower leg upwardly to engage the detent into the apertured latch plate, and said upper leg having a downturned tab formed from the one-piece stamping extending downwardly from the distal end thereof into closely spaced proximity with the distal end of the lower leg whereby the forced removal of the apertured latch plate from the housing carries the lower leg into engagement with the downturned tab to restrain the lower leg.

4. In a seat belt buckle of the type having a detent movably mounted in a housing for spring biased movement into engagement with an apertured latch plate insertable into the buckle, and a release button adapted for manual movement to urge the detent against the spring bias thereof to release the apertured latch plate, the improvement comprising:

the housing being a generally C-shaped one-piece stamping having upper and lower legs spaced apart to receive the apertured latch plate therebetween, a detent formed integral with the lower leg and projecting upward into the path of entry of the apertured latch plate so that the latch plate interacts with the detent to forcibly cam the lower leg downwardly away from the upper leg as permitted by integral elastic yielding of the lower leg relative to the upper leg;

the release button being mounted on the upper leg and being manually movable relative to the upper leg to move the lower leg downwardly and withdraw the detent from the apertured latch plate as permitted by integral elastic yielding of the lower leg relative to the upper leg;

and a plastic cover enclosing the housing and having an entry port aligning the apertured plate for insertion between the upper and lower legs.

* * * * *